US010603946B2

(12) United States Patent
Grossman

(10) Patent No.: US 10,603,946 B2
(45) Date of Patent: Mar. 31, 2020

(54) JOURNAL ATTACHMENT

(71) Applicant: Leslie Grossman, Jupiter, FL (US)

(72) Inventor: Leslie Grossman, Jupiter, FL (US)

( * ) Notice: Subject to any disclaimer, the term of this patent is extended or adjusted under 35 U.S.C. 154(b) by 98 days.

(21) Appl. No.: 15/952,324

(22) Filed: Apr. 13, 2018

(65) Prior Publication Data

US 2018/0297390 A1 Oct. 18, 2018

Related U.S. Application Data

(60) Provisional application No. 62/486,098, filed on Apr. 17, 2017.

(51) Int. Cl.

| | |
|---|---|
| ***B42D 3/14*** | (2006.01) |
| ***B42D 3/18*** | (2006.01) |
| ***A45C 11/34*** | (2006.01) |
| ***A45C 13/10*** | (2006.01) |
| ***A45C 11/18*** | (2006.01) |
| ***A45C 11/04*** | (2006.01) |
| ***A45C 13/30*** | (2006.01) |
| ***B42D 3/12*** | (2006.01) |
| ***B43K 23/00*** | (2006.01) |

(52) U.S. Cl.

CPC ..... *B42D 3/18* (2013.01); *A45C 11/04* (2013.01); *A45C 11/182* (2013.01); *A45C 11/34* (2013.01); *A45C 13/10* (2013.01); *A45C 13/103* (2013.01); *A45C 13/30* (2013.01); *B42D 3/12* (2013.01); *B43K 23/001* (2013.01); *A45C 2013/1015* (2013.01); *A45C 2013/306* (2013.01); *B42P 2241/16* (2013.01); *B42P 2241/18* (2013.01)

(58) Field of Classification Search

CPC ..... B65D 81/3876; B65D 81/3881; A47G 19/2272; A47G 19/2288; A47J 41/02; A47J 41/0061; B42D 3/14

USPC ..... 116/234; 220/592.24

See application file for complete search history.

(56) References Cited

U.S. PATENT DOCUMENTS 6,481,367 B2 * 11/2002 McClosky ..... B42D 3/14 116/234

2009/0114144 A1 * 5/2009 Keefe ..... B42D 9/005 116/234

* cited by examiner

*Primary Examiner* — King M Chu

(74) *Attorney, Agent, or Firm* — Brennan, Manna & Diamond, LLC

(57) ABSTRACT

A device that can be removably attached to an article, such as a book, tablet, journal, etc., and is useful for storing both related objects (e.g., pens, pencils, erasers, stylus, etc.) and unrelated objects (e.g., money, eye glasses, earbuds, check-book, etc.). The device is preferably comprised of a backing, a sleeve attached to said backing, a pocket also attached to said backing and an implement holder attached to said pocket. In a further preferred embodiment, a second pocket or slot may be incorporated onto said sleeve and the device may also have at least one zippered enclosure.

17 Claims, 4 Drawing Sheets

JOURNAL ATTACHMENT

CROSS-REFERENCE TO RELATED APPLICATION

This application claims priority from Provisional Patent Application Ser. No. 62/486,098 filed on Apr. 17, 2017.

FIELD OF THE INVENTION

This invention pertains generally to a device that can be removably attached to an article such as a book, tablet, journal, etc., and is useful for storing both related objects (e.g., pens, pencils, erasers, stylus, etc.) and unrelated objects (e.g., money, eye glasses, earbuds, cell phones, technical devices, checkbook, etc.).

BACKGROUND

It is oftentimes desirable for students, writers, reporters and the like to carry pens, pencils, stylus or other writing implements along with their books, tablets, journals, etc. so that the user can easily access the same. Further, it is oftentimes desirable for said users to also carry or transport items not necessarily related to the book or journal, such as money, eyeglasses, earbuds, cords, checkbooks, etc. in a secure and easily accessible device.

Heretofore, the above referenced items were typically carried or transported separately, particularly unrelated items, which made it difficult for the user to juggle or handle so many individual items at the same time, and lent itself to said items becoming misplaced, left behind or lost. Alternatively, users were forced to carry all of the items together in large, bulky containers, such as purses, fanny packs, back packs and the like, which resulted in commingling of the various items and making it difficult for the user to easily and quickly locate a specific item in a time of need.

Consequently, there exists a long felt need in the art for a device that can be removably attached to an article, such as a book, tablet, journal, etc. There is also a long felt need in the art for a device that is useful for storing both related objects (e.g., pens, pencils, erasers, stylus, etc.) and unrelated objects (e.g., money, eye glasses, earbuds, cell phones, checkbook, etc.) in a secure and easily accessible manner. Finally, there is a long felt need in the art for a device that accomplishes all of the forgoing objectives, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, is a device for attachment to a book, journal, tablet, etc., that is comprised of a sleeve, a backing, a pocket, an inner pocket, and an implement holder. In a further embodiment, the device of the present invention may further comprise at least one enclosure, such as a zippered enclosure. The device of the present invention is useful for storing and transporting both related objects (e.g., pens, pencils, erasers, stylus, etc.) and unrelated objects (e.g., money, eye glasses, earbuds, cell phones, checkbook, etc.) in a secure and easily accessible manner.

Of course, other variations and permutations of the device of the present invention are also disclosed herein. To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figures 1A, 1B, 1C, 1D, 1E:
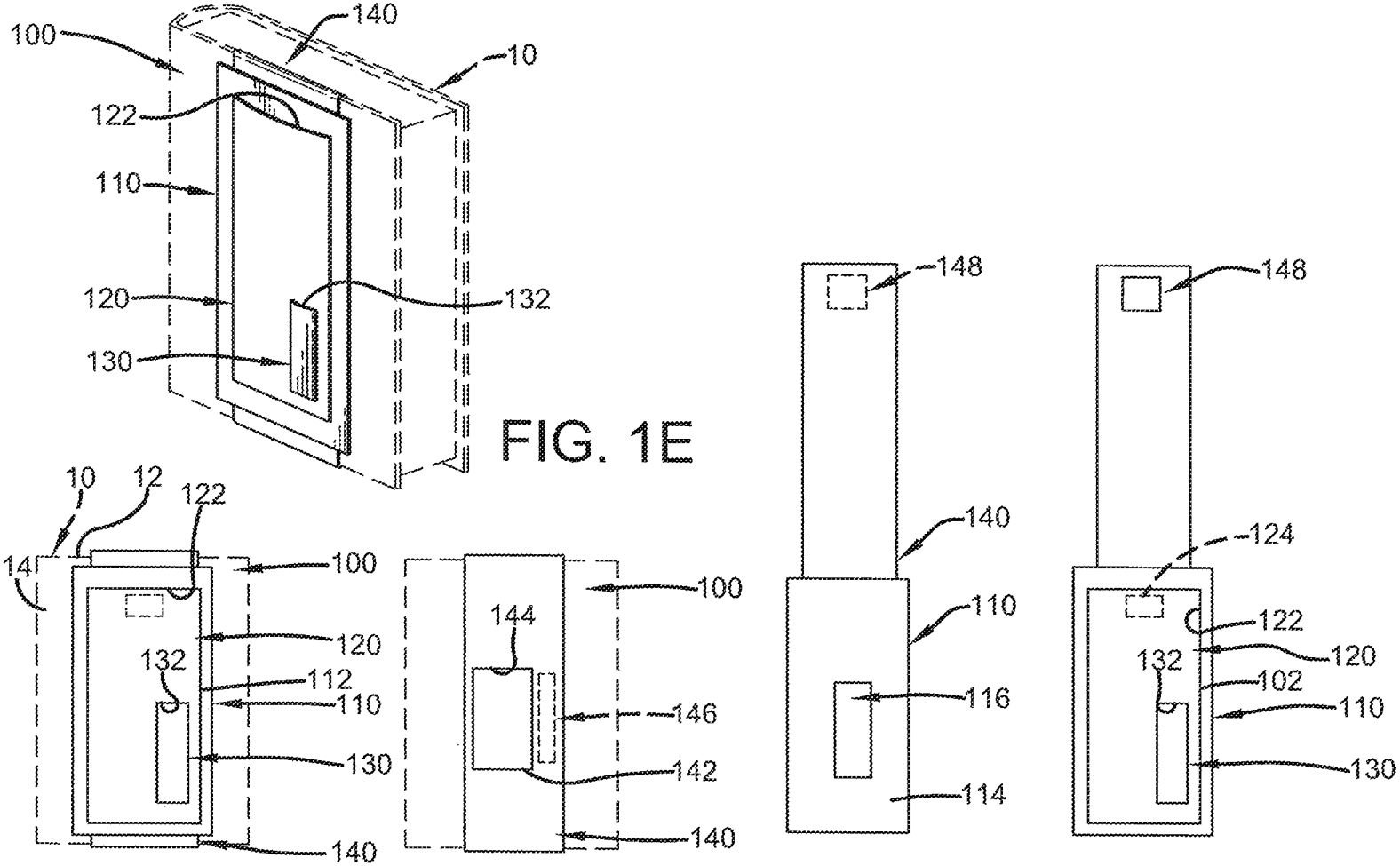
FIG. 1A is a front elevational view of one embodiment of the device of the present invention removably attached to a front cover of a book.
FIG. 1E is a perspective view of one embodiment of the device of the present invention removably attached to a front cover of a book.
FIG. 1B is a rear elevational view of one embodiment of the device of the present invention removably attached to a front cover of a book.
FIG. 1C is a rear elevational view of one embodiment of the device of the present invention.
FIG. 1D is a front elevational view of one embodiment of the device of the present invention.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Turning now to the drawings, FIG. 1A is a front elevational view of one embodiment of the device 100 of the present invention removably attached to a front cover 12 of a book 10, though device 100 could also be just as easily attached to a rear cover (not shown) of book 10 without affecting the overall concept of the present invention. Device 100 is preferably comprised of a backing 110, a pocket 120, an implement holder 130 and a sleeve 140.

Backing 110 is preferably comprised of a sturdy material such as cardboard, fabric, plastic, wood, metal or the like, and is comprised of a front surface 112 and a back surface 114, as best shown in FIG. 1A. In a preferred embodiment of the present invention, back surface 114 further comprises a backing fastener 116.

As best shown in FIGS. 1A and 1D, pocket 120 is preferably attached to the front surface 112 of backing 110 by any means commonly known in the art, such as adhesives, hook and loop fasteners, stitching, staples, etc. Pocket 120 is further comprised of an opening 122 and an interior space (not shown) that is useful for storing both articles related to said book 10, such as pens, pencils, erasers, stylus, etc., and unrelated objects such as money, eye glasses, earbuds, technical devices, computer mouse, checkbook, etc. Opening 122 may be on the top of pocket 120 (as shown in FIG. 1A), or on the side of pocket 120. Opening 122 may further comprise a closure mechanism 124 such as a zipper, hook and loop fastener, buttons, snaps, pins and magnets, etc., for securing the contents of pocket 120, and preventing the accidental or premature discharge thereof.

Implement holder 130 is preferably attached to pocket 120 by any means commonly known in the art, such as adhesives, hook and loop fasteners, stitching, staples, etc. Implement holder 130 is further comprised of an opening 132 and an interior space (not shown) that is useful for storing articles related to said book 10, such as pens, pencils, erasers, stylus, etc., and unrelated objects such as money, eye glasses, earbuds, checkbook, etc. Opening 130 may further comprise a closure mechanism (not shown) such as a zipper, hook and loop fastener, etc., for securing the contents of implement holder 130, and preventing the accidental or premature discharge thereof.

As best shown in FIGS. 1C-D, sleeve 140 is attached to said backing 110 and extends outwardly therefrom. More specifically, when device 100 is positioned on an outer surface 14 of book 10, sleeve 140 may be partially wrapped around front cover 12 and attached to the back surface 114 of backing 110 through the use of fasteners, such as hook and loop fasteners 116 and 148. In this manner, device 100 can accommodate and secure itself to a wide variety of books 10, journals or other articles of different shapes and sizes. Alternatively, it is also contemplated that sleeve 140 could be comprised of an elastic material and be in the general shape of a loop that could encircle outer front cover 12 (or rear cover) of book 10. As is best shown in FIG. 1B, sleeve 140 may be further comprised of a pocket or slot 142 with an opening 144 and an interior space (not shown) for storing money, a credit card, identification card or the like. Sleeve 140 may be further comprised of a product label or fashionable logo 146, as best shown in FIG. 1B, and hook and loop fastener 148, though other closure mechanisms could also be used.

Figure 2D:
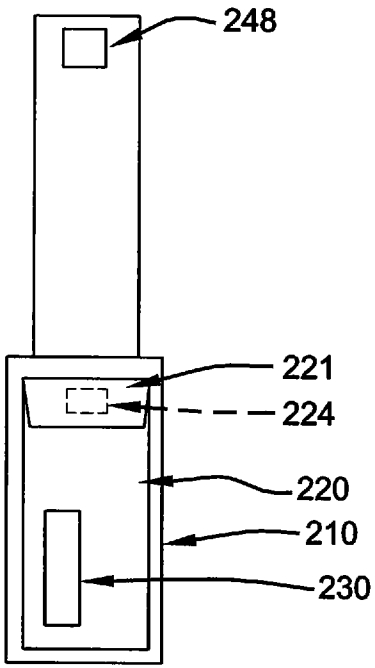
FIG. 2D is a front elevational view of the second embodiment of the device of the present invention.
Figure 2C:
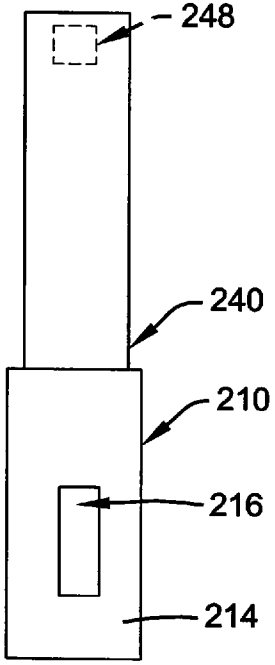
FIG. 2C is a rear elevational view of the second embodiment of the device of the present invention.
Figure 2B:
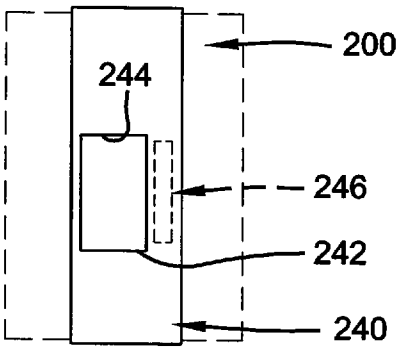
FIG. 2B is a rear elevational view of the second embodiment of the device of the present invention removably attached to a front cover of a book.
Figure 2A:
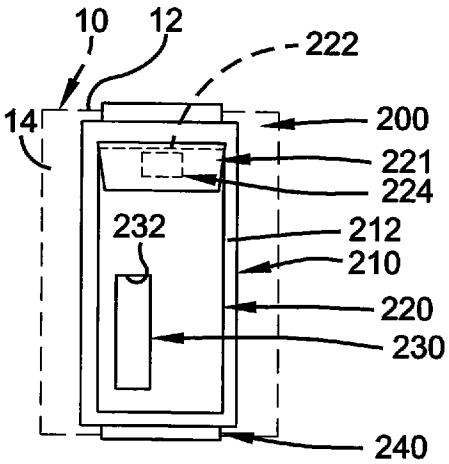
FIG. 2A is a front elevational view of a second embodiment of the device of the present invention removably attached to a front cover of a book.

FIG. 2A is a front elevational view of a second embodiment of the device 200 of the present invention removably attached to a front cover 12 of a book 10, though device 200 could also be just as easily attached to a rear cover (not shown) of book 10 without affecting the overall concept of the present invention. Device 200 is preferably comprised of a backing 210, a pocket 220, an implement holder 230 and a sleeve 240.

Backing 210 is preferably comprised of a sturdy material such as cardboard, plastic, wood, metal or the like, and is comprised of a front surface 212 and a back surface 214, as best shown in FIGS. 2A-D. In a preferred embodiment of the present invention, back surface 214 further comprises a backing fastener 216.

As best shown in FIGS. 2A and 2D, pocket 220 is preferably attached to the front surface 212 of backing 210 by any means commonly known in the art such as adhesives, hook and loop fasteners, stitching, staples, etc. Pocket 220 is further comprised of a flap 221, an opening 222 and interior space (not shown) that is useful for storing both articles related to said book 10, such as pens, pencils, erasers, stylus, etc., and unrelated objects such as money, eye glasses, earbuds, checkbook, etc. Opening 222 may be on the top of pocket 220, as shown in FIG. 2A, and flap 221 may be secured in a closed position through the use of hook and loop fasteners 224, which secures the contents of pocket 220, and prevents their accidental or premature discharge from pocket 220.

Implement holder 230 is preferably attached to pocket 220 by any means commonly known in the art such as adhesives, hook and loop fasteners, stitching, staples, etc. Implement holder 230 is further comprised of an opening 232 and interior space (not shown) that is useful for storing articles related to said book 10, such as pens, pencils, erasers, stylus, etc., and unrelated objects such as money, eye glasses, earbuds, checkbook, etc. Opening 230 may further comprise a closure mechanism (not shown) such as a zipper, hook and loop fastener, etc., for securing the contents of implement holder 230, and preventing the accidental or premature discharge thereof.

As best shown in FIGS. 2C-D, sleeve 240 is attached to said backing 210 and extends outwardly therefrom. More specifically, when device 200 is positioned on an outer surface 14 of book 10, sleeve 240 may be partially wrapped around front cover 12 and attached to the back surface 214 of backing 210 through the use of fasteners, such as hook and loop fasteners 216. In this manner, device 200 can accommodate and secure itself to a wide variety of books 10 of different shapes and sizes. Alternatively, it is also contemplated that sleeve 240 could be comprised of an elastic material and be in the general shape of a loop that could encircle outer front cover 12 (or rear cover) of book 10. As is best shown in FIG. 2B, sleeve 240 may be further comprised of a pocket or slot 242 with an opening 244 and interior space (not shown) for storing money, a credit card, identification card or the like. Sleeve 240 may be further comprised of a product label or fashionable logo 246, as best shown in FIG. 2B, and a fastener 248, as best shown in FIGS. 2C and 2D.

Figure 3D:
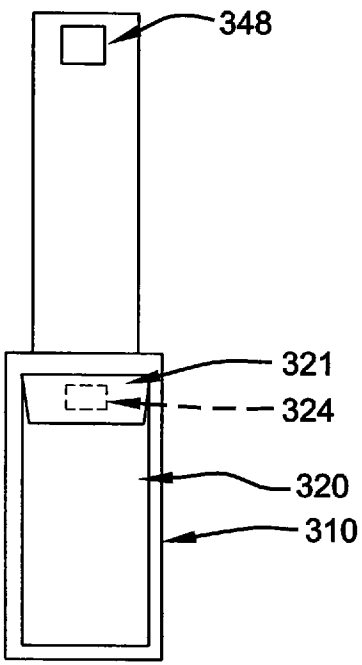
FIG. 3D is a front elevational view of the third embodiment of the device of the present invention.
Figure 3C:
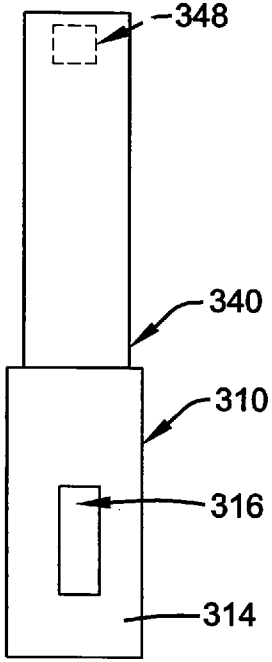
FIG. 3C is a rear elevational view of the third embodiment of the device of the present invention.
Figure 3B:
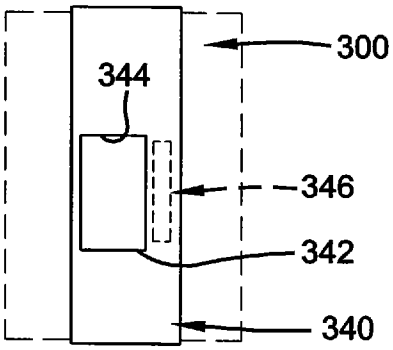
FIG. 3B is a rear elevational view of the third embodiment of the device of the present invention removably attached to a front cover of a book.
Figure 3A:
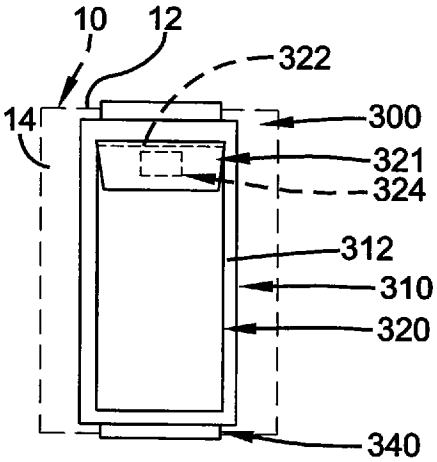
FIG. 3A is a front elevational view of a third embodiment of the device of the present invention removably attached to a front cover of a book.

FIG. 3A is a front elevational view of a further embodiment of the device 300 of the present invention removably attached to a front cover 12 of a book 10, though device 300 could also be just as easily attached to a rear cover (not shown) of book 10 without affecting the overall concept of the present invention. Device 300 is preferably comprised of a backing 310, a pocket 320 and a sleeve 340.

Backing 310 is preferably comprised of a sturdy material such as cardboard, plastic, wood, metal or the like, and is comprised of a front surface 312 and a back surface 314, as best shown in FIGS. 3A-D. In a preferred embodiment of the present invention, back surface 314 further comprises a backing fastener 316.

As best shown in FIGS. 3A and 3D, pocket 320 is preferably attached to the front surface 312 of backing 310 by any means commonly known in the art such as adhesives, hook and loop fasteners, stitching, staples, etc. Pocket 320 is further comprised of a flap 321, an opening 322 and interior space (not shown) that is useful for storing both articles related to said book 10, such as pens, pencils, erasers, stylus, etc., and unrelated objects such as money, eye glasses, earbuds, checkbook, etc. Opening 322 may be on the top of pocket 320, as shown in FIG. 3A, and flap 321 may be secured in a closed position through the use of hook and loop fasteners 324, which secures the contents of pocket 320, and prevents their accidental or premature discharge from pocket 320.

As best shown in FIGS. 3C-D, sleeve 340 is attached to said backing 310 and extends outwardly therefrom. More specifically, when device 300 is positioned on an outer surface 14 of book 10, sleeve 340 may be partially wrapped around front cover 12 and attached to the back surface 314 of backing 310 through the use of fasteners, such as hook and loop fasteners 316. In this manner, device 300 can accommodate and secure itself to a wide variety of books 10 of different shapes and sizes. Alternatively, it is also contemplated that sleeve 340 could be comprised of an elastic material and be in the general shape of a loop that could encircle outer front cover 12 (or rear cover) of book 10. As is best shown in FIG. 3B, sleeve 340 may be further comprised of a pocket or slot 342 with an opening 344 and interior space (not shown) for storing money, a credit card, identification card or the like. Sleeve 340 may be further comprised of a product label or fashionable logo 346, as best shown in FIG. 3B and a fastener 348, as best shown in FIGS. 3C and 3D.

Figure 4A:
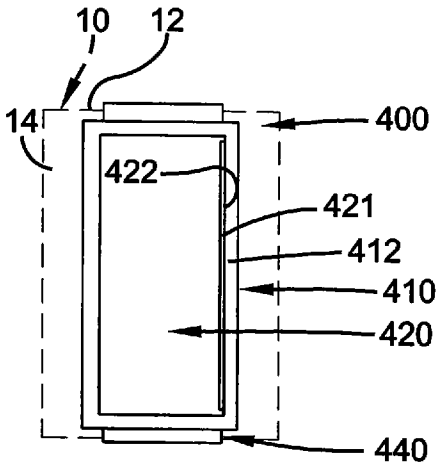
FIG. 4A is a front elevational view of a fourth embodiment of the device of the present invention removably attached to a front cover of a book.
Figure 4B:
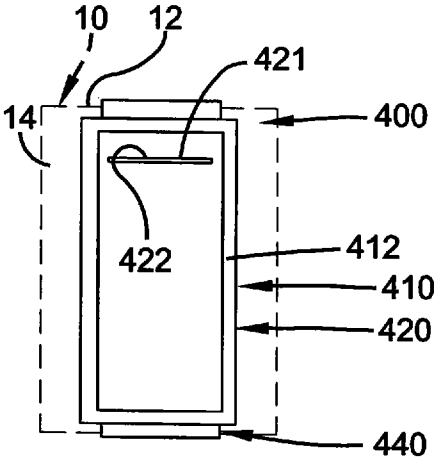
FIG. 4B is a front elevational view of a fifth embodiment of the device of the present invention removably attached to a front cover of a book.

FIGS. 4A and 4B are front elevational views of further embodiments of the device 400 of the present invention removably attached to a front cover 12 of a book 10, though device 400 could also be just as easily attached to a rear cover (not shown) of book 10 without affecting the overall concept of the present invention. Device 400 is preferably comprised of a backing 410, a pocket 420 and a sleeve 440.

Backing 410 is preferably comprised of a sturdy material such as cardboard, plastic, wood, metal or the like, and is comprised of a front surface 412 and a back surface 414, as best shown in FIGS. 4A-E. In a preferred embodiment of the present invention, back surface 414 further comprises a backing fastener 416.

As best shown in FIGS. 4A, B and E, pocket 420 is preferably attached to the front surface 412 of backing 410 by any means commonly known in the art such as adhesives, hook and loop fasteners, stitching, staples, etc. Pocket 420 is further comprised of a zipper closure 421, an opening 422 and interior space (not shown) that is useful for storing both articles related to said book 10, such as pens, pencils, erasers, stylus, etc., and unrelated objects such as money, eye glasses, earbuds, checkbook, etc. Opening 422 and zipper closure 421 may be located on the side of pocket 420 as shown in FIG. 4A, at the top of pocket 420 as shown in FIG. 4B, or any other convenient location to suit user preference. Zipper enclosure 421 is useful for securing the contents of pocket 420, and prevents their accidental or premature discharge from pocket 420.

Figure 4C:
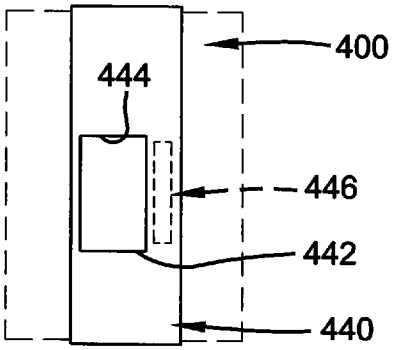
FIG. 4C is a rear elevational view of the fourth or fifth embodiment of the device of the present invention removably attached to a front cover of a book.
Figure 4D:
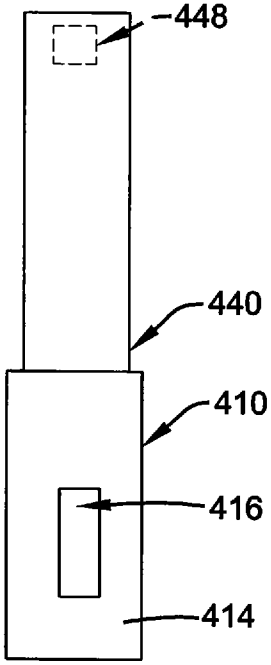
FIG. 4D is a rear elevational view of the fourth or fifth embodiment of the device of the present invention.
Figure 4E:
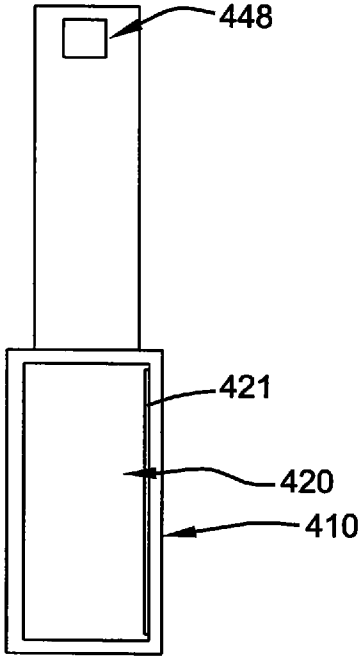
FIG. 4E is a front elevational view of the fourth embodiment of the device of the present invention.

As best shown in FIGS. 4C-D, sleeve 440 is attached to said backing 410 and extends outwardly therefrom. More specifically, when device 400 is positioned on an outer surface 14 of book 10, sleeve 440 may be partially wrapped around front cover 12 and attached to the back surface 414 of backing 410 through the use of fasteners, such as hook and loop fasteners 416. In this manner, device 400 can accommodate and secure itself to a wide variety of books 10 of different shapes and sizes. Alternatively, it is also contemplated that sleeve 440 could be comprised of an elastic material and be in the general shape of a loop that could encircle outer front cover 12 (or rear cover) of book 10. As is best shown in FIG. 4C, sleeve 440 may be further comprised of a pocket or slot 442 with an opening 444 and interior space (not shown) for storing money, a credit card, identification card or the like. Sleeve 440 may be further comprised of a product label or fashionable logo 446, as best shown in FIG. 4C and a fastener 448, as best shown in FIGS. 4D and 4E.

The device of the present invention, in its various embodiments described herein, can be removably attached to an article, such as a book, tablet, journal, etc., and is useful for storing and transporting both related objects (e.g., pens, pencils, erasers, stylus, etc.) and unrelated objects (e.g., money, eye glasses, earbuds, cell phones, checkbook, etc.) in a secure and easily accessible manner. Finally, the device of the present invention accomplishes all of the forgoing objectives, and is relatively inexpensive to manufacture and safe and easy to use.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A device for attachment to a book like structure having a front cover and a rear cover, wherein said device is comprised of:

a backing comprised of a front surface and a back surface, wherein said back surface further comprises a backing fastener;

a pocket attached to said backing;

an implement holder; and a sleeve attached to said backing, wherein said sleeve further comprises an inner pocket.

2. The device of claim 1 wherein said pocket further comprises a slot.

3. The device of claim 1 wherein said sleeve further comprises a fastener.

4. The device of claim 1 wherein said device is further comprised of a second implement holder and at least one zippered enclosure.

5. The device of claim 1 wherein said device is further comprised of an eyeglass holder.

6. The device of claim 1 wherein said device is comprised of a computer mouse holder.

7. A device for attachment to a book like structure having a front cover and a rear cover, wherein said device is comprised of:

a backing comprised of a front surface and a back surface, wherein said back surface further comprises a backing fastener;

a pocket attached to said backing, wherein said pocket further comprises an opening therein;

a flap attached to said backing for closing said opening;

an implement holder attached to said pocket; and a sleeve attached to said backing, wherein said device is further comprised of a second implement holder and at least one zippered enclosure.

8. The device of claim 7 wherein said pocket and said flap are attached via a fastener.

9. The device of claim 8 wherein said fastener is a hook and loop fastener.

10. The device of claim 7 wherein said sleeve further comprises a slot.

11. The device of claim 7 wherein said sleeve further comprises a fastener.

12. The device of claim 7 wherein said device is further comprised of an eyeglass holder, a cord holder or a computer mouse holder.

13. The device of claim 7 wherein said device is attached to said front or rear cover via a fastener.

14. A device for attachment to a book like structure having a front cover and a rear cover, wherein said device is comprised of:

a backing comprised of a front surface and a back surface, wherein said back surface further comprises a backing fastener;

a pocket attached to said backing, wherein said pocket further comprises an opening therein; and a sleeve attached to said backing, wherein said device is attached to said front cover via hook and loop fasteners and is further comprised of at least one zippered enclosure.

15. The device of claim 14 wherein said device further comprises (a) a flap attached to said backing wherein said pocket and said flap are removably attached via a fastener, and (b) an implement holder.

16. The device of claim 14 wherein said fastener is a hook and loop fastener.

17. The device of claim 14 wherein said sleeve further comprises a slot and a fastener.

* * * * *